US005461789A

United States Patent [19]

Beerens

[11] Patent Number: 5,461,789

[45] Date of Patent: Oct. 31, 1995

[54] ROLLER NOSE CHAIN SAW GUIDE BAR

[76] Inventor: Thomas Beerens, 25 Fisher Court, Sunbury 3429 Victoria, Australia

[21] Appl. No.: 144,836

[22] Filed: Oct. 28, 1993

[30] Foreign Application Priority Data

Oct. 28, 1992 [AU] Australia ..... PL5546
May 28, 1993 [AU] Australia ..... PL9053

[51] Int. Cl.[6] ..... B27B 17/04

[52] U.S. Cl. ..... 30/384; 83/820; 83/825

[58] Field of Search ..... 30/383, 384; 83/820, 83/825

[56] References Cited

U.S. PATENT DOCUMENTS

| | | | |
|---|---|---|---|
| 2,839,096 | 6/1958 | Cutrone . | |
| 2,888,964 | 6/1959 | Mall | 30/384 |
| 3,198,222 | 8/1965 | Bowen, III | 30/384 |
| 3,602,274 | 8/1971 | Barrett | 83/825 |
| 3,762,047 | 10/1973 | Scott-Jackson . | |
| 3,765,088 | 10/1973 | Arff | 30/384 |
| 4,159,569 | 7/1979 | Sundstrom . | |
| 4,813,135 | 3/1989 | Kuwica | 30/384 |

*Primary Examiner*—Hwei Siu Payer
*Attorney, Agent, or Firm*—Scully, Scott, Murphy & Presser

[57] ABSTRACT

A chain saw guide bar having two opposed nose plates at the free end thereof. Each nose plate has an outwardly formed impression which faces the outwardly formed impression in the opposed nose plate, to allow a thicker idler roller assembly to be mounted between the outwardly formed impressions. The idler roller assembly includes an inner bearing journal, roller bearings, and an idler roller with a concave groove around its outer circumference, within which groove the drive links of the saw chain track. Two thin shims are placed on opposite sides of the idler roller assembly between the nose plates. A replacement nose assembly is also disclosed which includes two substantially identical outer plates positioned apart a given distance. An idler roller bearing assembly is positioned between the two outer plates, and includes an inner bearing journal having a thickness the same as the given distance, bearings, and an outer idler roller having a thickness smaller than the given distance and the inner bearing journal.

12 Claims, 4 Drawing Sheets

ROLLER NOSE CHAIN SAW GUIDE BAR

BACKGROUND OF THE INVENTION

1. Field of the Invention

The present invention relates generally to improvements in guide bars for chain saws, and more particularly pertains to improvements in the design to an idler roller used in the free end of a chain saw guide bar.

2. Discussion of the Prior Art

It is currently standard practice in the prior art to use an idler sprocket in the free end of a chain saw guide bar, which is a sprocket wheel journaled on a bearing plate (or ring) by a roller (or ball) bearing. The prior art has also used an idler roller, a round wheel journaled on a bearing plate (or ring) by a roller (or ball) bearing to lift the side links, of a currently popular type of endless saw chain comprised of center drive links and laterally opposed side links, off the guide bar rails by supporting the drive links as the saw chain travels around the free end of the chain saw guide bar.

An idler roller is much preferred to an idler sprocket because it results in the generation of much less friction during operation, generating less heat, and providing a faster chain speed and faster cutting. Moreover, a single roller is usable with a wide range of chains of different pitch, whereas an idler sprocket must be designed for a particular pitch of chain. However, idler rollers of current design are prone to frequent failure. The present invention provides a design for an idler roller used in the free end of a chain saw guide bar which prevents these typical modes of failure in prior art idler rollers.

Currently, two typical constructions exist for supporting an idler roller within flat parallel nose plates on the free end of a chain saw guide bar:

1. The nose plates are formed by being left when the recess is machined into a solid one piece guide bar; or
2. The nose plates are formed by the outer two laminations of a laminated guide bar or laminated nose assembly attached to a solid one piece guide bar.

In previous prior art designs, the thickness of the idler roller was limited by the gap between the nose plates at the point where the drive links enter the nose, because the nose plates were flat and parallel. This limitation allowed the drive links, after considerable wear, to force their way down between the toothless idler roller and one of the side plates, hence jamming rotation of the idler roller and causing premature failure of the guide bar.

SUMMARY OF THE INVENTION

Accordingly, it is a primary object of the present invention to provide improvements in guide bars for chain saws.

A further object of the subject invention is the provision of improvements in the design of an idler roller used in the free end of a chain saw guide bar.

In accordance with the teachings herein, the present invention provides two improvements in the design of an idler roller used in the free end of a chain saw guide bar to ensure that the drive links of the saw chain do not enter between the nose plates and the idler roller.

1. Within the free end of the guide bar, outwardly extending impressions are formed in each of the side nose plates, allowing the use of an idler roller of greater thickness than could be used in the normal prior art gap between parallel nose plates.

2. A groove is machined in the outer circumference of the idler roller in which the drive links of the chain track, stopping the chain from wearing a path down between the idler roller and one of the side nose plates.

It has also been found that it is difficult to mount the rollers of the bearing between the side nose plates of the guide bar when manufacturing or repairing the guide bar. In order to facilitate the mounting of the idler roller between the side nose plates, two thin flat plates are placed on opposite sides of the idler roller which encompass part of the surface of the bearing journal and part of the bearing rollers.

The present invention provides an improved design for an idler roller in the free end of a chain saw guide bar which results in the generation of much less friction during operation, thus providing smoother performance and a longer life, generating less heat, and providing a faster chain speed and faster cutting. Moreover, a single roller is usable with a wide range of saw chains of different pitch. The oversized roller bearings also provide for tighter saw chain tensioning and improved guide bar life and performance. Moreover, a single rivet assembly allows for easy replacement of the parts at the free end of the guide bar.

In accordance with the teachings herein, the present invention provides a chain saw having a guide bar, around which a saw chain rotates, with the guide bar having two opposed nose plates at the free end thereof. Each nose plate has an outwardly formed impression which faces the outwardly formed impression in the opposed nose plate, and an idler roller assembly is mounted between the outwardly formed impressions. The idler roller assembly includes an idler roller with a concave groove around its outer circumference, within which groove, the drive links of the saw chain track as the saw chain rotates around the idler roller.

In greater detail, the idler roller assembly comprises the idler roller, an inner bearing journal, and roller bearings mounted therebetween. The idler roller is preferably constructed of specially hardened alloy steel for maximum strength, and the concave groove is machined in its outer circumference. Moreover, two thin flat plates or shims are placed on opposite sides of the idler roller assembly between the nose plates and the idler roller assembly to facilitate mounting of the idler roller assembly between the nose plates. The two thin shims preferably encompass or overlay the bearing journal and at least part of the bearing rollers.

Moreover, an outer side plate is secured to each nose plate, for mounting and positioning each shim and the roller bearing assembly within the nose plates. Each nose plate has a circular hole formed therein, with a beveled edge, located centrally within the outwardly formed impression. Each outer side plate is circular and includes a beveled edge matching the beveled edge of the circular hole in the nose plate so that each outer side plate mounts within the circular hole. Each outer side plate includes a centrally extending round projection which positions and mounts therearound each shim and the inner journal of the roller bearing assembly. Each outer side plate is also formed with a central hole therein, and a rivet extends through the central hole in each outer side plate to assemble the components together.

The present invention also provides a replacement nose assembly for a chain saw guide bar which contains an idler roller bearing at the free end of the guide bar to lift the saw chain off the guide bar as the saw chain travels around the free end. The replacement nose assembly includes two substantially identical outer plates positioned apart a given distance to allow the passage of drive tangs of the saw chain between the two outer plates while allowing side plates of the saw chain to be supported by the periphery of the two outer plates. An idler roller bearing assembly is positioned between the two outer plates, and includes an inner bearing journal, bearings, and an outer idler roller having a thickness smaller than the thickness of the inner bearing journal. The arrangement is such that the idler roller bearing assembly supports the bottom of drive tangs of the saw chain to lift the side plates of the saw chain off the periphery of the two outer plates while the saw chain travels around the free end of the chain saw guide bar. The two substantially identical outer plates can optionally be positioned apart by a third separator plate, which has the same thickness as the inner bearing journal. The replacement nose assembly is fitted and attached longitudinally to the guide bar by extending portions of the two outer plates which fit into recesses provided on the end of the guide bar so that the attached nose assembly is substantially the same thickness as the guide bar.

BRIEF DESCRIPTION OF THE DRAWINGS

The foregoing objects and advantages of the present invention for a roller nose chain saw guide bar may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE DRAWINGS

Figure 1:
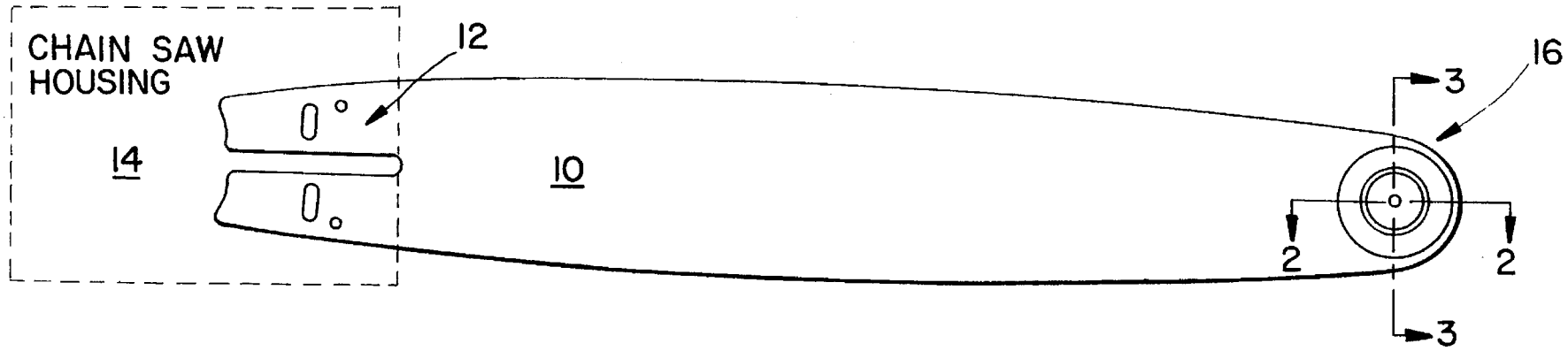
FIG. 1 is a side view of a guide bar for a chain saw constructed pursuant to the teachings of the present invention.
Figure 2:
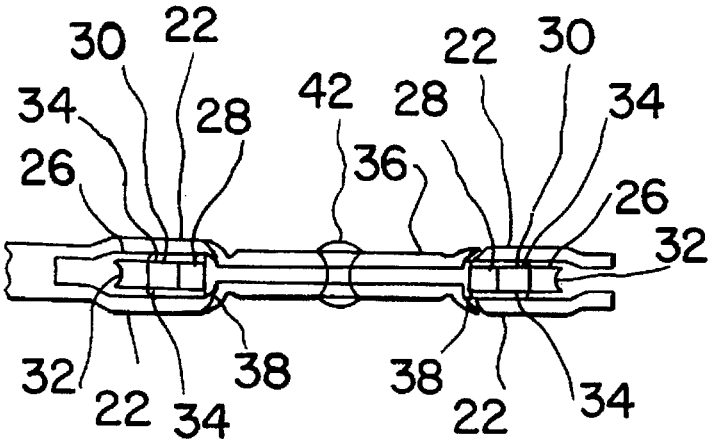
FIG. 2 is a sectional view along lines 2—2 in FIG. 1, illustrating details of the construction of the nose plates and the idler roller, with the dimensions illustrated in FIG. 2 approximating those of an actual embodiment.
Figure 4:
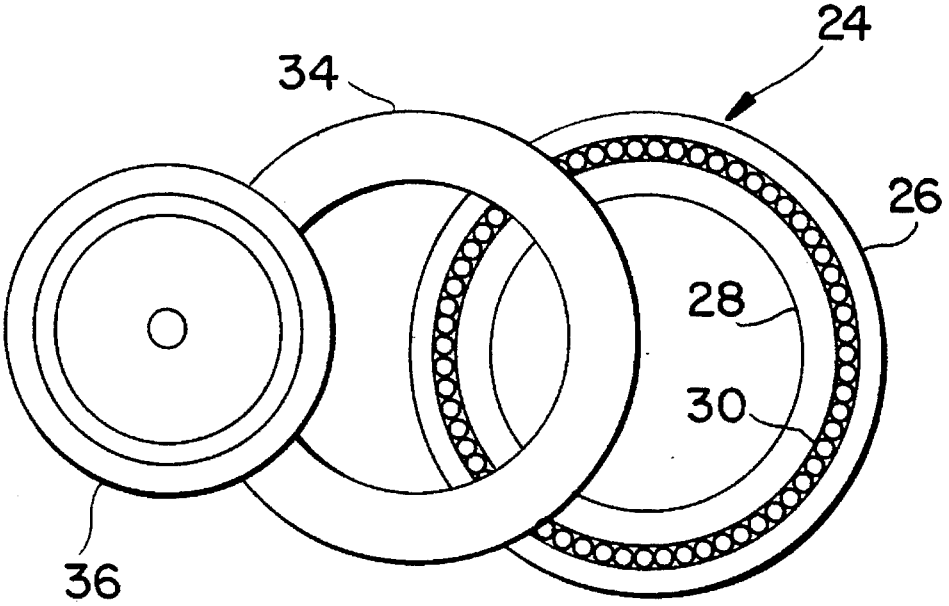
FIG. 4 is a partially exploded view of one side of the idler roller, a metal shim placed thereover, and an outer cover plate.
Figure 3:
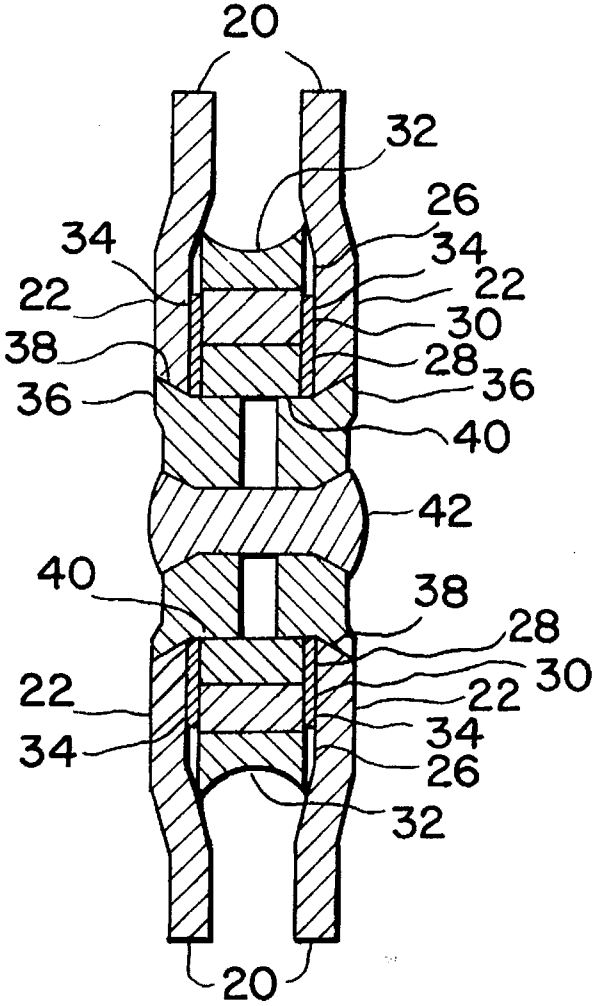
FIG. 3 is a schematic view along lines 3—3 in FIG. 1 which is similar to FIG. 2, but wherein the component sizes are enlarged and exaggerated to illustrate more clearly the nature of the construction of the present invention.

Referring to the drawings in detail, FIG. 1 is a side view of a guide bar 10 for a chain saw constructed pursuant to the teachings of the present invention. The chain saw guide bar includes a typical prior art mounting arrangement 12 of an adjustment slot and bolt holes for mounting the guide bar to the main housing and motor 14 of the chain saw. The saw chain is guided in a groove around the periphery of the guide bar to travel to and from the free end 16 of the guide bar, at which an idler roller is inventively mounted pursuant to the teachings of the present invention. In the embodiment described herein, the free end 16 of the guide bar is formed with two side nose plates or laminations 20, FIGS. 2 and 3, each of which is formed with an outwardly extending circular impression 22, as illustrated in FIGS. 2 and 3, to allow the placement therebetween of an idler roller assembly 24, FIG. 4, of greater thickness than the normal gap formed between parallel nose plates as in prior art designs.

The roller bearing assembly 24 includes an outer steel roller 26, an inner bearing journal 28, and roller bearings 30 mounted between the outer roller 26 and inner journal 28. The outer roller 26 of the roller bearing is constructed of specially hardened alloy steel for maximum strength, and is constructed with a concave groove 32 machined in its outer circumferential surface, in which the drive links of the chain track, to prevent the chain from wearing a path down between the idler roller assembly and one of the side nose plates 20. The outer roller 26 could also be formed of other high strength engineering materials such as ceramic or case hardened mild steel. The wider width roller bearings 30 also provide lower friction and higher cutting speeds for the chain saw.

It has also been found that it is difficult to mount the rollers of the bearing between the side nose plates 30 of the guide bar 10 when producing or repairing the guide bar. Accordingly, in order to facilitate the mounting of the idler roller between the side nose plates 30, a metal shim 34 is mounted on each side of the roller bearing assembly 24 beneath each nose plate 22 to lock in the roller bearings 30 and for increased performance. Each outer metal shim 34 encompasses the lateral surface of the bearing journal 28 and at least part of the surface of the bearing rollers 26. The diameter of the shims 34 preferably smaller than the inner diameter of the outer roller 26 to eliminate the possibility of frictional contact and rubbing of the two thin shims 34 with the outer roller 26 during operation, which can generate significant friction and heat. By displacing the shims 34 slightly off center prior to assembly, all benefits remain as to their assistance during assembly.

The assembly is mounted together by two outer side plates 36 which are mounted on each nose plate 20, and mount and position each shim 34 and the roller bearing assembly within the nose plates. Each nose plate 20 is constructed with a circular hole formed therein having a beveled edge 38, and each outer side plate 36 is circular and includes a beveled edge matching the beveled edge 38 of the nose plate 20 so that each outer side plate 36 mounts within the circular hole. Each side plate 36 includes a centrally extending round projection 40 which properly positions and mounts each shim 34 and the inner journal 28 of the roller bearing assembly therearound. A rivet 42 extends through a central hole in each outer side plate 36, to assemble the components together. The one rivet assembly 42 also provides for easy replacement of the components at the free end of the guide bar.

Figure 5:
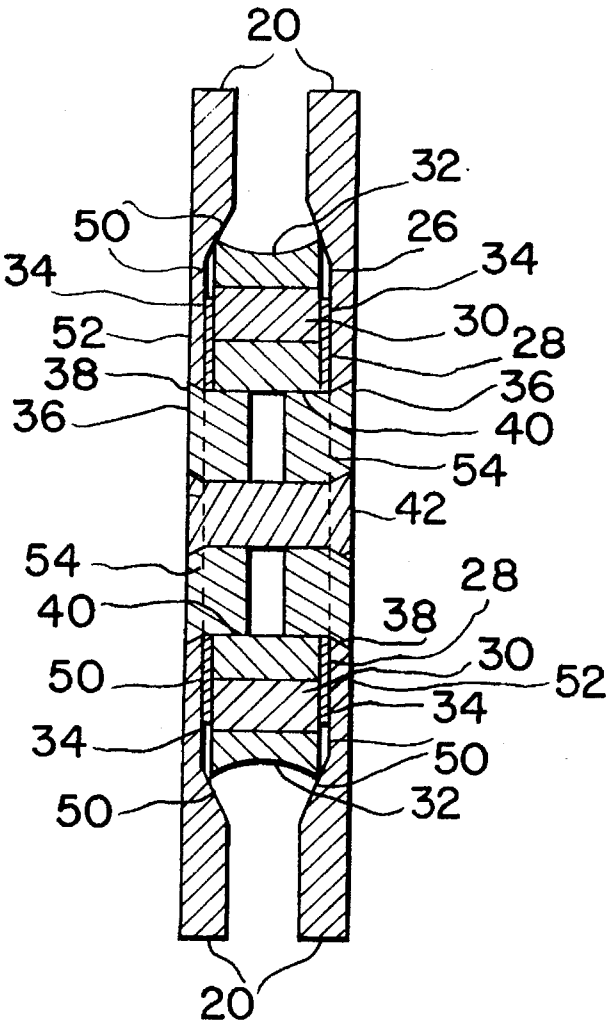
FIG. 5 is a schematic view similar to FIG. 3 illustrating several alternative embodiments of the present invention.

FIG. 5 illustrates a schematic view similar to FIG. 3, showing several alternative embodiments of the present invention. FIGS. 2 and 3 of the drawings illustrate outwardly extending circular impressions 22 formed in the nose plates 20 which are created as a result of forming the outwardly extending recesses within the nose of the guide bar by a preferred manufacturing method. However, in alternative embodiments as illustrated in FIG. 5, the recess for the idler roller bearing 24 might be machined on the inside of each nose plate at 50 before assembly to accommodate the extra thickness of the idler roller 24. Alternatively, the outwardly extending impressions 22 may be ground flat as illustrated at 52, thereby allowing the practice of the present invention without outwardly extending impressions 22 which can be seen from the outside of the guide bar.

The embodiment of FIG. 5 is illustrated with two cover plates 36, mounted flush with the exterior surface 52, and secured together by a rivet 42. In alternative embodiments, the cover plates 36 can be omitted, and the interior surface of each nose plate 20 could be extended as illustrated by dashed lines 54 to encompass the roller bearing assembly 24. In this embodiment, the inner bearing journal 28 can extend to and be positioned directly around the rivet 42. The nose plates 20 would be forced apart to allow placement of the bearing assembly 24 therein, and the rivet 42 would then secure the assembly together.

Although a preferred embodiment of the present invention preferably utilizes roller bearings 30, alternative embodiments could use ball bearings instead.

The present invention also relates to an improvement in U.S. Pat. No. 2,839,096 for a SAW CHAIN GUIDE BAR. This patent uses an idler roller bearing to support the saw chain at the free end of a chain saw guide bar, an area of a chain saw guide bar which experiences excessive loading of the saw chain onto the guide bar, and hence of excessive wear. This patent discloses a chain saw guide bar constructed of three pieces, with an idler roller bearing supported within the free end of the chain saw guide bar between two outer plates of the guide bar. This configuration is not commercially feasible because the bar would be totally destroyed if the roller failed. This failure occurs after excessive wear on the idler roller which then allows the drive tangs of the saw chain to slip between the idler roller and the outer plate of the guide bar.

The present invention relates to the recognition of this design failure and the realization that an idler roller is much more economical to produce than a standard idler sprocket used by almost all chain saw guide bar manufacturers. A replacement nose assembly has been invented using an idler roller bearing, providing a cheap replacement nose assembly which can easily be replaced if and when the roller fails without having to discard the entire chain saw guide bar. Thus all the advantages of an idler roller bearing, higher chain speed, simpler construction and cheaper manufacture can be provided by a relatively inexpensive replacement part.

Figure 7:
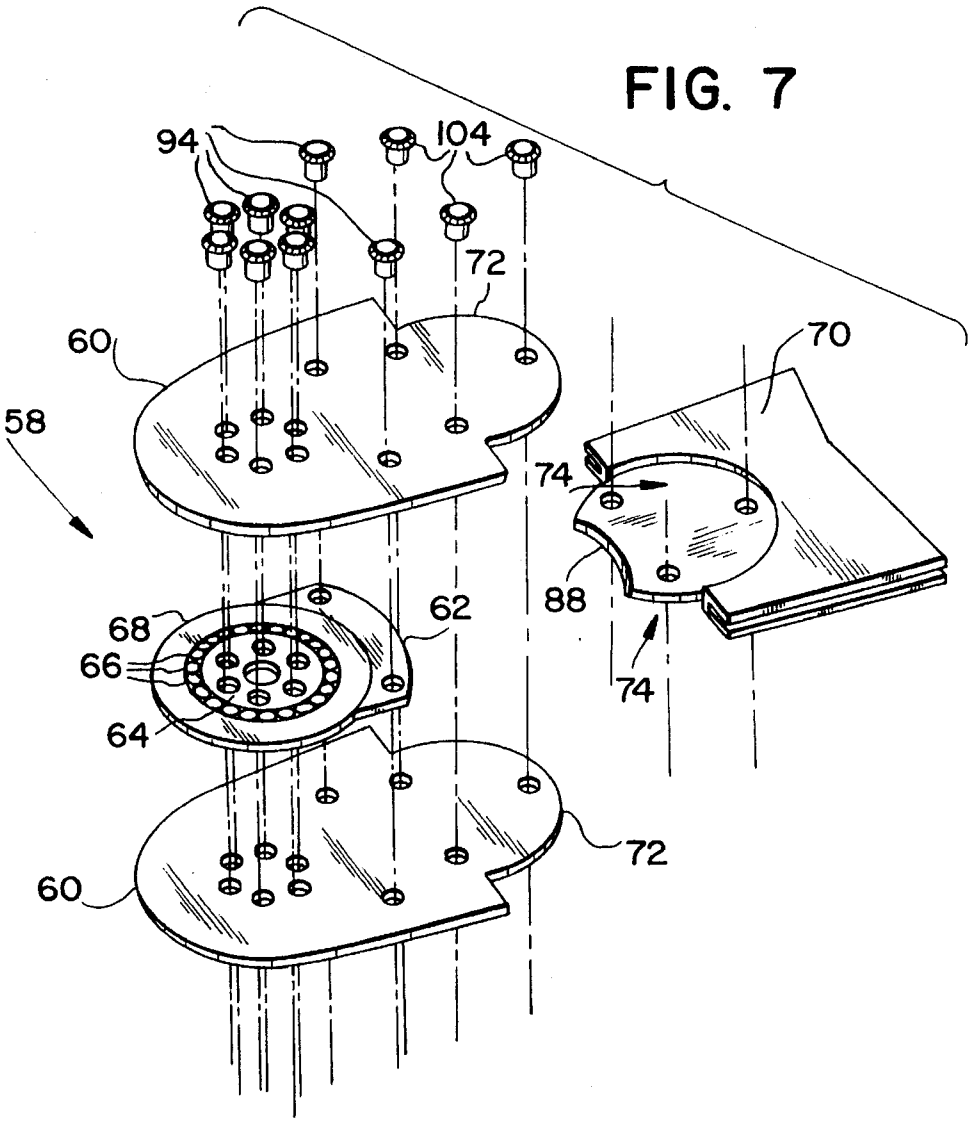
FIG. 7 is an exploded perspective view of the components of the embodiment of FIG. 6.
Figure 6:
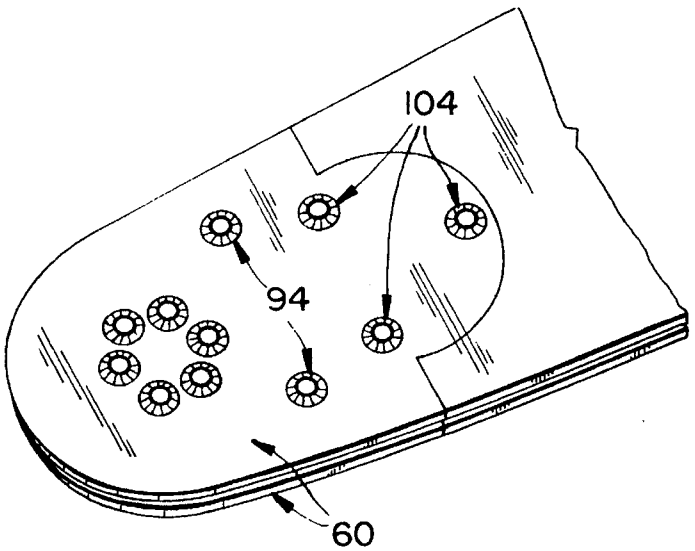
FIG. 6 is a side perspective view of a replacement nose assembly for a chain saw guide bar pursuant to another embodiment of the present invention.

Referring to FIGS. 6 and 7, the replacement nose assembly 58 includes two substantially identical outer plates 60 positioned apart a preset distance sufficient to allow the passage of the drive tangs of the saw chain between the two outer plates 60 while allowing side plates of the saw chain to be supported by the periphery of the two outer plates 60. An idler roller bearing assembly is positioned between the two outer plates 60, and consists of an inner bearing journal 64, a plurality of bearings 66, and an outer idler roller 68 having a thickness just slightly smaller than the thickness of the inner bearing journal 64. In one embodiment, the inner bearing Journal has a thickness the same as the preset distance. In an alternative embodiment, the thickness of the inner bearing journal 64 can be reduced, and the given distance is maintained by adding a thin shim on each side of the bearing journal to space the two nose plates by the correct distance.

In a further alternative embodiment, a third separator plate 62, having a thickness the same as the preset distance between the two outer plates 60, can be optionally included in the assembly. However, it is emphasized that the third separator plate 62 may be omitted in other embodiments, thereby allowing only the inner bearing journal 64 to provide the preset distance, or the inner bearing journal and optional spacers or shims to provide the preset distance. The idler roller 68 supports the bottom of the drive tangs of the saw chain to lift the side plates of the saw chain off the periphery of the two outer plates 60 while the chain travels around the free end of the chain saw guide bar.

The replacement nose assembly 58 is attached longitudinally to a chain saw guide bar 70 designed specifically to fit the replacement nose assembly. The replacement nose assembly 58 is fitted to the chain saw guide bar 70 by connectors in the form of extensions 72 of the two outer plates 60 fitting into recesses 74 provided on both sides of the end of the chain saw guide bar 70.

The recesses 74 are formed in opposite faces of guide bar 70, and extend longitudinally thereof and open outwardly toward the end of the guide bar. A portion of the guide bar 70 is left between the recesses 74 in the form of a flange or web 88. The extensions 72 are shaped to fit within the recesses 74 on opposite sides thereof while overlaying flange 88. A spacer 62 is optionally positioned between outer plates 60 and extensions 72, and is shaped to fit adjacent to the outer end of flange 88, while being as close as practical to, but spaced from, idler roller 68.

The two outer plates 60 are secured to each other and to the journal 64 in any suitable manner, such as in the illustrated embodiment by a plurality of rivets 94 extending through the outer plates 60, the inner bearing journal 64 and the optional spacer 62.

When assembly 58 is mounted in place on the guide bar 70, the assembly 58 is held in position by three rivets 104 which extend through the two out plates 60 or connector extensions 72 and flange 88.

The arrangement is such that the attached nose assembly does not substantially increase the guide bar thickness, preferably allowing the nose assembly to be the same thickness as the guide bar 70.

The replacement nose attachment 58 makes up a minor percentage of the chain saw guide bar overall length. The longitudinal length of the replacement nose assembly 58 is just sufficient to ensure that the idler roller is fully encompassed by the two outer plates 60 and covers a significant length of chain travel on and off the idler roller bearing, regions where significant bar wear is normally experienced due to the sudden change in direction of the saw chain as it passes around the free end of the chain saw guide bar.

It should also be noted that many different designs can be used in the manufacture of toothed sprocket replacement nose assemblies utilizing many different shapes of extensions 72, some overlapping a recess in the middle of the bar as illustrated in the drawings, some overlapping the entire width of the bar, and some overlapping web sections at the edges of the bar using two extensions 72. Some nose plate assemblies have a third separator plate and many different combinations of rivets can be used in the connection to the guide bar.

Although nose assembly 58 is subjected to great strain as the saw chain cuts into wood, the assembly is firmly secured to and braced by the outer end of the guide bar 70, even though the assembly is secured to the bar by only three rivets 104. The fit of connector extensions 72 into the slots 74 on opposed sides of the guide bar 70, and against the flange 88, brace the assembly against any forces tending to force it out of the plane of the guide bar. If it is necessary to change assembly 58 for replacement, it is only necessary to remove the three rivets 104. Thus, the assembly 58 can be easily and quickly changed. Furthermore, the idler roller reduces the friction at the nose end of the bar so that the saw chain runs much faster and thereby cuts more quickly through wood, or less power can be used to attain the same cutting speed.

While several embodiments and variations of the present invention for a roller nose chain saw guide bar are described in detail herein, it should be apparent that the disclosure and teachings of the present invention will suggest many alternative designs to those skilled in the art.

What is claimed is:

1. A chain saw guide bar for supporting a saw chain which rotates around the guide bar, comprising:

a. said guide bar having a free end with two opposed substantially parallel, nonrotational nose plates fixed to the free end, with a normal preset gap being defined between the outwardly formed recess at the free end which opposes the parallel nose plates, each guide bar nose plate having an outwardly formed recess in the opposed nose plate to provide a mounting gap therebetween greater than said normal present gap;

b. an idler roller assembly mounted within said mounting gap between the outwardly formed recesses in the nose plates, said idler roller assembly having an idler roller with a width greater than the normal preset gap between the parallel nose plates, and wherein said idler roller has a concave groove formed in the outer circumference of the idler roller, within which concave groove the saw chain tracks as it rotates around the idler roller.

2. A chain saw guide bar as claimed in claim 1, wherein said idler roller assembly comprises said idler roller, an inner bearing journal, and bearings mounted between said idler roller and said inner journal, and further including two thin flat plates placed on opposite sides of the idler roller assembly between said nose plates and the idler roller assembly to facilitate mounting of the idler roller assembly between the nose plates, with said flat plates encompassing the inner bearing journal and at least part of the bearings.

3. A chain saw guide bar for supporting a saw chain which rotates around the guide bar, comprising:

a. said guide bar having a free end with two opposed substantially parallel, nonrotational nose plates fixed to the free end, with a normal preset gap being defined between the parallel nose plates, each guide bar nose plate having an outwardly formed recess at the free end which opposes the outwardly formed recess in the opposed nose plate to provide a mounting gap therebetween greater than said normal preset gap;

b. an idler roller assembly mounted within said mounting gap between the outwardly formed recesses in the nose plates, said idler roller assembly having an idler roller with a width greater than the normal preset gap between the parallel nose plates, and wherein said idler roller assembly comprises said idler roller, an inner bearing journal, and bearings mounted between said idler roller and said inner journal, and further including two thin flat plates placed on opposite sides of the idler roller assembly between said nose plates and the idler assembly to facilitate mounting of the idler roller assembly between the nose plates, with said flat plates encompassing the inner bearing journal and at least part of the bearings.

4. A chain saw guide bar as claimed in claim 3, further including an outer side plate secured to each nose plate, for mounting and positioning each said thin flat plate and the idler roller assembly within the nose plates.

5. A chain saw guide bar for supporting a saw chain which rotates around the guide bar, comprising:

a. said guide bar having a free end with two opposed substantially parallel nose plates at the free end of the guide bar;

b. an idler roller assembly mounted between the two opposed nose plates and having an idler roller with a concave groove formed in the outer circumference of the idler roller, within which concave groove the saw chain tracks as it rotates around the idler roller.

6. A chain saw guide bar as claimed in claim 5, wherein said idler roller assembly comprises said idler roller, an inner bearing journal, and bearings mounted between said idler roller and said inner journal, and further including two thin flat plates placed on opposite sides of the idler roller assembly between said nose plates and the idler roller assembly to facilitate mounting of the idler roller assembly between the nose plates, with said flat plates encompassing the inner bearing journal and at least part of the bearings.

7. A replacement nose assembly for a chain saw guide bar, comprising:

a. two substantially spaced apart identical outer plates to be positioned at a free end of the guide bar, said outer plates being spaced apart by a given distance to allow the passage of drive tangs of a saw chain between said two outer plates while allowing side plates of the saw chain to be supported by the periphery of said two outer plates;

b. an idler roller bearing assembly positioned between said two outer plates at the free end of the guide bar and including an inner bearing journal, bearing means, and an outer idler roller having a thickness smaller than said given distance, with the idler roller bearing assembly supporting the bottom of drive tangs of the saw chain to lift the side plates of the saw chain off the periphery of the two outer plates while the saw chain travels around the free end of the chain saw guide bar.

8. A replacement nose assembly for a chain said guide bar as claimed in claim 7, wherein the outer idler roller has a thickness smaller than that of the inner bearing journal.

9. A replacement nose assembly for a chain said guide bar as claimed in claim 8, wherein said two substantially identical outer plates are positioned part by a third separator plate, and said third separator plate has a thickness the same as said given thickness.

10. A replacement nose assembly for a chain saw guide bar as claimed in claim 7, wherein said two substantially identical outer plates are positioned apart by a third separator plate, and said third separator plate has a thickness the same as said given thickness.

11. A replacement nose assembly for a chain saw guide bar as claimed in claim 7, and further including two thin flat plates placed on opposite sides of the idler roller assembly between said two outer plates and the idler roller assembly to facilitate mounting of the idler roller assembly between the two outer plates, with said flat plates encompassing the inner bearing journal and at least part of the bearing means, and wherein the total thickness of the inner bearing journal and the two thin flat plates is substantially the same as said given thickness.

12. A replacement nose assembly for a chain saw guide bar as claimed in claim 7, wherein the replacement nose assembly has substantially the same thickness as the guide bar.

* * * * *

UNITED STATES PATENT AND TRADEMARK OFFICE

CERTIFICATE OF CORRECTION

PATENT NO. : 5,461,789

DATED : October 31, 1995

INVENTOR(S) : Thomas Beerens

It is certified that error appears in the above-indentified patent and that said Letters Patent is hereby corrected as shown below:

Column 5, line 52: "Journal" should read --journal--

Column 7, lines 11-12: delete "the outwardly formed recess at the free end which opposes"

Column 7, line 13: after "recess" insert --at the free end which opposes the outwardly formed recess--

Signed and Sealed this

Second Day of July, 1996

*Attest:*

*Attesting Officer*

BRUCE LEHMAN

*Commissioner of Patents and Trademarks*